United States Patent [19]

Davies et al.

[11] Patent Number: 4,592,780

[45] Date of Patent: Jun. 3, 1986

[54] PRODUCTION OF FLAT PRODUCTS IN STRIP SHEET OR LIKE FORM

[75] Inventors: Idwal Davies, Mold, Wales; John L. Fage, Ellesmere, England

[73] Assignee: Mixalloy Limited, Clywd, Wales

[21] Appl. No.: 719,699

[22] Filed: Apr. 4, 1985

[30] Foreign Application Priority Data

Apr. 7, 1984 [GB] United Kingdom ..... 8409046

[51] Int. Cl.[4] ..... B22F 1/00

[52] U.S. Cl. ..... 75/229; 75/228; 75/245; 419/3; 419/4; 419/24; 419/31; 419/32; 419/36; 419/37; 419/38; 419/40; 419/55

[58] Field of Search ..... 419/3, 4, 24, 31, 37, 419/32, 40, 36, 38, 55; 75/228, 229, 245, DIG. 1

[56] References Cited

U.S. PATENT DOCUMENTS

| | | | |
|---|---|---|---|
| 3,335,000 | 8/1967 | Bliss | 419/43 |
| 3,653,884 | 4/1972 | Davies et al. | 419/43 |
| 3,658,517 | 4/1972 | Davies et al. | 419/43 |
| 3,681,062 | 8/1972 | Jackson | 419/43 |
| 3,796,563 | 3/1974 | Wieland | 419/43 |
| 3,839,026 | 10/1974 | Gibbon | 419/43 |

FOREIGN PATENT DOCUMENTS 0086507 8/1983 European Pat. Off. .

*Primary Examiner*—Stephen J. Lechert, Jr.
*Attorney, Agent, or Firm*—Kinney & Lange

[57] ABSTRACT

A process for producing a flat product such as a coin includes the steps of forming a slurry comprising a suspension of particulate material in a film-forming cellulose derivative, depositing a quantity of this slurry onto a support surface, drying the slurry to form a self-supporting flat product, and removing the dried product from the support surface. The particulate material essentially comprises metallic particles and matter whose chemical composition and physical properties differ from those of the metallic particles such that the added matter is not or only partially taken into solution with the metallic particles on heat treatment of the product whereby the presence of the added matter can readily be detected following such heat treatment.

12 Claims, No Drawings

PRODUCTION OF FLAT PRODUCTS IN STRIP SHEET OR LIKE FORM

The invention concerns the production of flat products from particulate material. By "flat products" is meant products in strip, sheet, disc or like form.

Hitherto, immediate authenticity of coins, tokens, medallions and other valuable items has relied upon the presence of features which can be detected either visually or by tough. Alternatively, the weight or dimensions of such items have been used for authentication, particularly in coin operated machinery. Since such features can readily be reproduced, there is always the possibility of forgery or of a coin or token of inferior value being presented in payment for goods or services.

The present invention sets out to provide a process for producing such items which include authentication features which cannot readily be reproduced. The invention also sets out to provide a process by which the intrinsic value of items such as coins or medallions or the like can be increased by the presence of high value materials.

According to the present invention in one aspect, there is provided a process for producing a flat product which includes the steps of forming a slurry comprising a suspension of particulate material in a film-forming cellulose derivative, depositing a quantity of this slurry onto a support surface, drying the slurry to form a self-supporting flat product, and removing the dried product from the support surface, the particulate material essentially comprising metallic particles and matter whose chemical composition and physical properties differ from those of the metallic particles such that the added matter is not or only partially taken into solution with the metallic particles on heat treatment of the product and the presence of the added matter can readily be detected following such heat treatment.

The metallic and added matter may be mixed together into a single slurry. Alternatively, separate slurries of the metallic and added matter may be produced, deposited onto support surfaces, dried and superimposed or abutted to produce a laminated or stratified product.

The metallic particles may be produced from powders of any common metal or metal alloy, e.g. copper, iron, nickel or silver or from alloys of such metals, including bronze, brass or steel. The added matter may be metallic or non-metallic. In one embodiment of the invention, the metallic particles are produced from a non-magnetic material such as copper or copper nickel, and the other particles from a material having magnetic properties, e.g. a ferrite material. Thus, the presence of the ferrite particles within the product following heat treatment can readily be detected by simple magnetic test. Other physical properties and tests can also be used. Such testing may, for example, occur automatically in a coin or token operated machine.

Where a layered or stratified product is produced, authentication may be accomplished visually through suitable selection of the materials employed.

In a further embodiment, the intrinsic value of a flat product such as a coin may be increased by the addition of high value particulate material, such as micron or greater size particles of natural or synthetic diamonds to the metal powder.

The added matter may be in particulate or filamentary form.

According to the present invention in another aspect, there is provided a process for producing a flat product which includes the steps of forming a slurry of a suspension of metallic particles in a film-forming cellulose derivative, depositing a quantity of the slurry onto a support surface, drying the slurry to form a self-supporting flat product, removing the dried product from the support surface and introducing into the deposited slurry or dried product, metallic or non-metallic matter whose chemical composition and physical properties differ from those of the metallic particles such that the introduced matter is not or only partially taken into solution with the metallic particles on heat treatment of the product and the presence of the introduced matter can readily be detected following such heat treatment.

The introduced matter may, for example, include high value items such as gems to increase the intrinsic value of the product.

The invention further provides a coin, token, medallion or the like produced by a process as described herein.

The flat product may be produced in strip or sheet form. In one embodiment exemplary of the invention, a layer of the slurry of the particulate metallic and added particles in a film-forming cellulose derivative is deposited by a set of rollers onto a belt for transport through a drying oven. On leaving the oven, the strip is self-supporting and may be compacted by means of a pair of contra-rotating rolls.

The dried, compacted strip is then heat treated within a sinter furnace and can, if required, be further rolled and heat treated. If required, disc or similar shaped product may be stamped or cut from the heat treated or further processed strip. On heat treatment, the metallic particles coalesce to form a sintered product about the other particles which are not taken or only partially taken into solution with the principal metal particles. The presence of the other particles can, therefore, readily be detected by a simple test linked to a difference in the physical properties of the particles.

Alternatively, disc or similar shaped flat products may be stamped or cut from the dried strip prior to heat treatment, the individual discs then being subjected to the required heat treatment.

In an alternative embodiment exemplary of the invention, separate slurries comprising suspension of metallic material and another material whose chemical and physical properties differ from those of the metallic material are produced. Each slurry is separately deposited by a set of rotating rollers onto a belt and transported through a drying oven. The self-supporting strips are then superimposed one on the other to form a laminate comprising two or more layers which is subjected to compaction and sintering stages similar to those referred to above.

By suitable selection of the metallic and other particulate matter, authentication may be achieved either visually or by means of a simple test.

In an alternative embodiment, the slurry of the particulate metal and added particles in a film-forming cellulose derivative is cast or injected into moulds located on a support surface, the cast products then being dried and subjected to compaction in a press and/or heat treatment in a manner similar to that described above. Alternatively, separate slurries of the metallic and other particles may be formed, the slurries being sequentially cast or injected as superimposed layers or as side-by-side deposits to form a laminated or stratified product.

The process described above provides an even dispersion of the added particles within the slurry thereby ensuring an even distribution of the authentication particles within the products.

In a further embodiment, a slurry comprising a suspension of metallic particles in a film-forming cellulose derivative is deposited onto a support surface or cast or injected into discrete moulds as described above and matter having chemical and/or physical properties different to those of the metallic particles is then introduced into the deposited or cast slurry either before or after drying. The dried slurry deposit may be subjected to compaction and heat treatment before introduction of the added matter. By this process, items such as gems may be introduced into the product to increase the intrinsic value thereof.

The added matter may take the shape of filaments of fibres produced from magnetic or non-magnetic metallic or non-metallic material. Typical examples of such matter include carbon fibres and stainless steel filaments. Where magnetic filaments or fibres are employed, they may be aligned lengthwise generally parallel to the longitudinal axis of the strip by a magnetic alignment device. Alternatively, where relatively long fibres or filaments are used, alignment may be achieved by suitable selection of the roll gap between the previously described pair of rotating coating rollers.

Alignment of fibres or filaments in directions transverse or inclined to the longitudinal axis of the strip can also be achieved by a suitable magnetic device. Furthermore, the fibres or filaments may be indiscriminately disposed by employing shorter fibres or filaments and/or a roll gap for the coating rollers which would not automatically cause the fibres or filaments to be aligned.

Whilst the invention has been described with particular reference to the production of items whose authenticity can be magnetically or visually determined, it is to be understood that various other properties can be employed for authentication purposes by suitable selection of the materials employed.

Such properties include, but are not limited to, mass, density, weight, porosity and chemical reactivity.

We claim:

1. A process for producing a flat product which includes the steps of:
   - forming a slurry from a film forming cellulose derivative containing, in suspension, a quantity of metallic particles and a quantity of added matter whose chemical composition and physical properties differ from those of the metallic particles;
   - mixing the slurry to disperse the metallic particles and added matter uniformly within the cellulose derivative whereby the slurry comprises a substantially homogeneous mix of the metallic particles and added matter in suspension within the cellulose derivative;
   - depositing a quantity of this slurry onto a support surface;
   - heating the slurry to promote gelling of the cellulose derivative to retain the homogeneity achieved in the slurry;
   - drying the slurry to form a self-supporting dried flat product;
   - removing the dried flat product from the support surface;
   - compacting the dried flat product; and
   - heating the compacted dried flat product to a temperature at which the added matter is, at most, only partially taken into solution with the metallic particles whereby the presence of evenly distributed added matter can readily be detected following such heat treatment.

2. A process as claimed in claim 1 wherein the metallic particles are powders of copper, iron, nickel or silver or alloys of such metals.

3. A process as claimed in claim 1 wherein the metallic particles are non-magnetic and the added matter is produced from a material having magnetic properties.

4. A process as claimed in claim 1 wherein the added matter is a ferrite material.

5. A process as claimed in claim 1 wherein the added matter comprises metallic fibres having magnetic properties.

6. A process as claimed in claim 1 wherein the added matter comprises high value items such as gems to increase intrinsic value of the product.

7. A coin, token, medallion or the like produced by a process as claimed in claim 1.

8. A process for producing a flat product which includes the steps of:
   - forming a first slurry from a film forming cellulose derivative containing, in suspension, a quantity of metallic particles;
   - forming a second slurry from a film-forming cellulose derivative containing, in suspension, a quantity of added matter whose chemical composition and physical properties differ from those of the metallic particles;
   - mixing each slurry to disperse the metallic particles or added matter uniformly within the respective cellulose derivative whereby each slurry comprises a substantially homogeneous mix of the metallic particles or added matter in suspension within the respective cellulose derivative;
   - depositing a quantity of each slurry onto a support surface in abutting or superimposed relationship;
   - heating the deposited slurries to promote gelling of the cellulose derivative to retain homogeneity;
   - drying the deposited slurries to form a self-supporting laminated or stratified flat dried product;
   - removing the dried product from the support surface;
   - compacting the dried product; and
   - heating the compacted dried product to a temperature at which the added matter is, at most, only partially taken into solution with the metallic particles whereby the presence of evenly distributed added matter can readily be detected following such heat treatment.

9. A process as claimed in claim 8 wherein the metallic particles are non-magnetic and the added matter is produced from a material having magnetic properties.

10. A process as claimed in claim 8 wherein the added material comprises metallic fibres having magnetic properties.

11. A process as claimed in claim 8 wherein the added matter comprises high value items such as gems to increase intrinsic value of the product.

12. A coin, token, medallion or the like produced by a process as claimed in claim 8.

* * * * *